US006089570A

United States Patent [19]

Gruber

[11] Patent Number: 6,089,570

[45] Date of Patent: Jul. 18, 2000

[54] BALL AND TARGET GAME

[75] Inventor: Baylis M. Gruber, Cape Coral, Fla.

[73] Assignee: Bay USA, Inc., Cape Coral, Fla.

[21] Appl. No.: 09/100,697

[22] Filed: Jun. 19, 1998

[51] Int. Cl.[7] ..... A63B 67/00

[52] U.S. Cl. ..... 273/348.4; 273/118 R; 273/127 R

[58] Field of Search ..... 273/348.3, 348.4, 273/348.5, 118 R, 118 A, 127 R, 127 A, 350

[56] References Cited

U.S. PATENT DOCUMENTS 4,026,556 5/1977 Taylor et al. ..... 273/127 B X
5,139,278 8/1992 Rudell et al. ..... 273/348.4
5,358,742 10/1994 Ziff ..... 273/348.4 X
5,603,504 2/1997 Powell ..... 273/348.4

*Primary Examiner*—Sam Rimell
*Attorney, Agent, or Firm*—William E. Noonan

[57] ABSTRACT

A ball and target game includes a spherical element and an elongate target element carrying a plurality of discrete target areas, which areas are juxtaposed longitudinally on the target element. The spherical element and the target element carry complementary hook and loop components or magnetic components that enable the spherical element to releasably attach to the target element within a selected target area when the spherical element is projected at and strikes the target element within that target area.

13 Claims, 5 Drawing Sheets

BALL AND TARGET GAME

FIELD OF INVENTION

This invention relates to a ball and target game and, more particularly, to a game that may be played on either a substantially flat horizontal surface or in a pool or other body of water.

BACKGROUND OF THE INVENTION

Recently, electronic and computerized games have become extremely popular. However, a need continues to exist for manual games which are fun and exciting and which serve to challenge and develop the participants' motor skills, as well as hand and eye coordination. These types of games are particularly helpful for children and persons with learning or physical disabilities.

To date, a number of known toss and catch varieties of games employ hook and loop fasteners. In such games, a loop covered ball is tossed between two persons carrying respective paddles covered by a complementary hook material. Each person is required to hold and manipulate a target paddle while playing the game.

SUMMARY OF THE INVENTION

It is therefore an object of the present invention to provide a ball and target game, which is fun and exciting and which may be played by persons of all ages.

It is a further object of this invention to provide ball and target game that employs relatively stationary targets that do not have to be carried or manipulated by the participants during the game.

It is a further object of this invention to provide a ball and target game that may be played on either a horizontal surface by rolling the ball toward the target or in a body of water by tossing the ball toward the target.

It is a further object of this invention to provide a ball and target game that may utilize a wide variety of target configurations, rules and scoring systems.

It is a further object of this invention to provide a ball and target game that challenges the participants' motor skills and helps to develop manual dexterity and hand and eye coordination.

It is a further object of this invention to provide a ball and target game that provides physical, therapeutic and remedial benefits to children as well as physically and mentally challenged individuals.

It is a further object of this invention to provide a ball and target game that is very simple to set up and play and which does not require extensive rules or complicated and costly electronics and equipment.

This invention features a ball and target game adapted for use on either a generally horizontal playing surface or in a body of water. In the former version, the game includes a spherical element and a target element having a base portion that engages the playing surface and a targeted side portion extending generally vertically upwardly from the base portion. The target element carries means for defining a plurality of discrete target areas within the side portion. The spherical element and the side portion of the target element support complementary means for releasably attaching the spherical element to the side portion of the target element, within a selected target area, when the spherical element rolls across the playing surface and strikes the side portion of the target element within the selected target area.

In the water version, the game includes a spherical element that is sufficiently buoyant to float at the surface of the body of water. The game further includes a target element that is sufficiently buoyant to float at the surface of the body of water. The target element includes an upper portion that is generally exposed above the upper surface of the water as the target element floats thereon. The upper portion of the target element carries means for defining a plurality of discrete target areas. The spherical element and the upper portion of the target element support complementary means for releasably attaching the spherical element to the upper portion of the target element, within a selected target area, when the spherical element is projected at and strikes the upper portion of the target element within the selected target area.

In preferred embodiments, the target element includes an elongate bar and the target areas are juxtaposed longitudinally on the bar. The bar preferably includes a rectilinear shape. More particularly, in the version of the game that is played on a generally horizontal surface, the base may include a substantially flat bottom surface.

The means for defining may include indicia that assign respective scoring values to the target areas. The means for defining may also include a plurality of discrete color or respectively shaped regions that are associated with respective target areas.

The means for releasably attaching may include complementary hook and loop components. In the horizontal playing surface embodiment, one of those components may include hook material that is attached to one of the outer surface of the spherical element and the side portion of the target element. The other of the hook and loop components may include loop material that is attached to the other of the outer surface of the spherical element and the side portion of the target element. The loop material releasably interengages the hook material to attach the spherical element to the target element.

In the water version of the game, the complementary hook and loop components may also be used. Once again, hook material is attached to one of the spherical element and the target element and complementary loop material is attached to the other of the spherical element and the target element. Preferably, the hook material is supported on an exposed, generally horizontal top surface of the target element. At least one of the spherical element and the target element may comprise a closed cell foam material, which enables such elements to float in the body of water wherein the game is played.

The game may also be played in environments other than on a horizontal playing surface or in the water. In such versions, an elongate target element employing longitudinally juxtaposed target areas is utilized.

DETAILED DESCRIPTION OF PREFERRED EMBODIMENTS

Other objects, features and advantages will occur from the following description of preferred embodiments and the accompanying drawings, in which.

Figure 1:
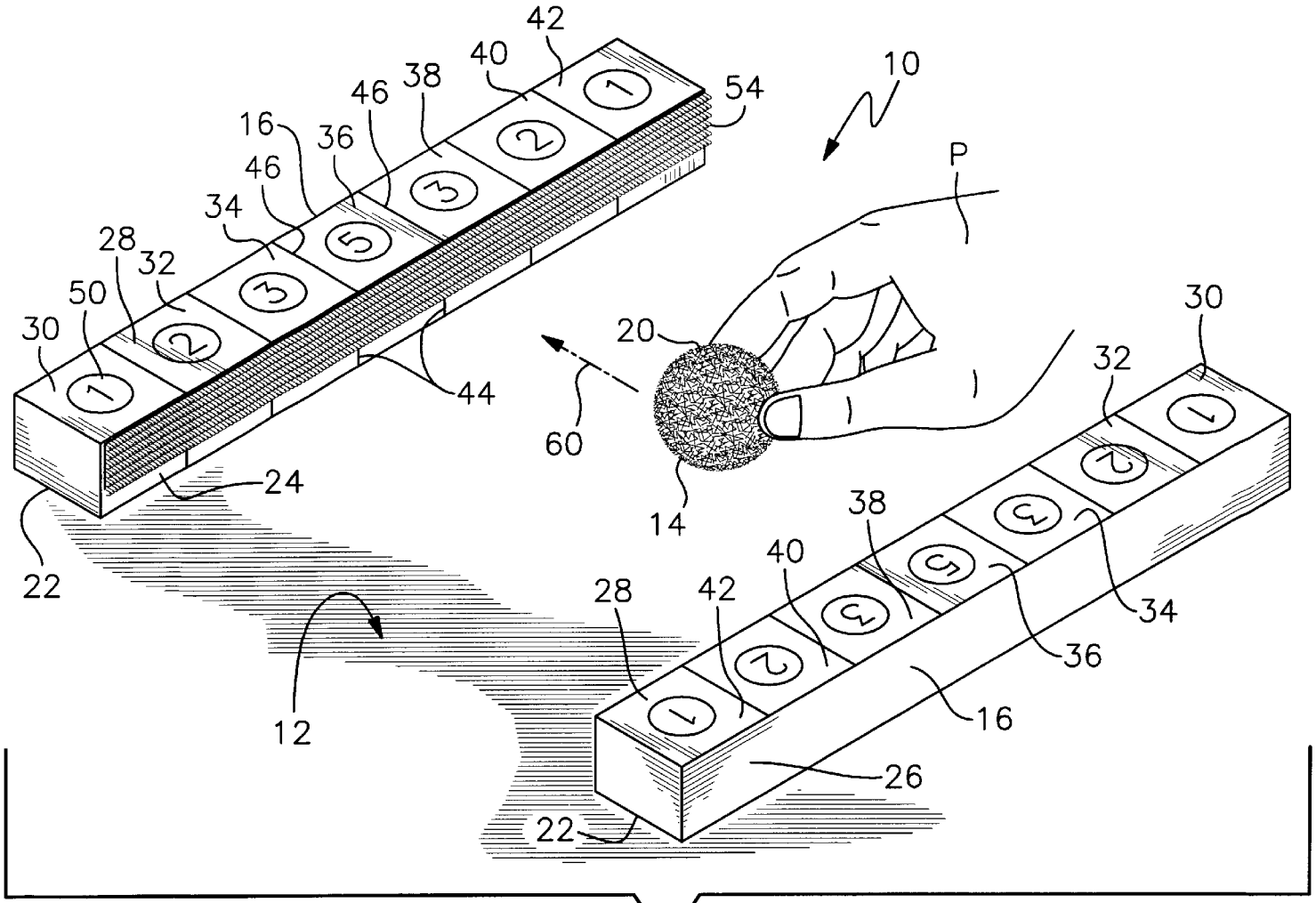
FIG. 1 is a perspective view of a preferred version of the ball and target game of this invention as played on a horizontal surface.

There is shown in FIG. 1 a ball and target game 10 that is played on a generally horizontal playing surface 12. The playing surface may comprise a floor, table, patio, driveway or other substantially flat and horizontal surface. It should be noted that this surface does not necessarily have to be smooth and may comprise carpeting, concrete, asphalt, etc. Additionally, the game is intended to be played on a generally and not necessarily perfectly horizontal or level surface. Slight undulations and sloping may be present.

Figure 2:
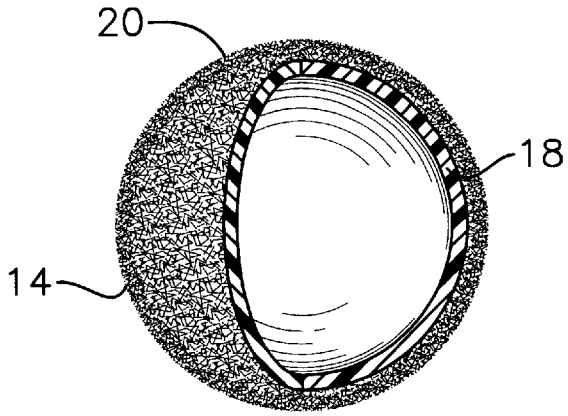
FIG. 2 is an elevational, partly cut away view of a preferred spherical element.

Game 10 features a spherical element or ball 14, which is shown alone in FIG. 2. The game also includes a pair of elongate, spaced apart target elements 16. A representative one of the target elements is shown cross sectionally in FIG. 3. The game is utilized by rolling ball 14 toward target 16 such that the ball strikes and adheres to the target in a manner that will be described more fully below.

Ball 14 may have a wide variety of compositions and constructions. The version illustrated in FIG. 2 includes a spherical shell 18 that is composed of a material similar to the material forming a typical tennis ball. The shell has a substantially hollow interior. In alternative versions, the ball may be composed of a wide variety of synthetic and natural materials, including, foam, rubber, etc. The outer surface of shell 18 is covered by a conventional hook and loop fastening component, namely loop material 20. The loop material is formed in a known, fabric-like fashion and is wrapped about and secured to shell 18 in a manner that will be known to those skilled in the art. Loop material 20 should have a thickness that does not interfere or impede in any way with the rolling of ball 20 across playing surface 12.

Figure 3:
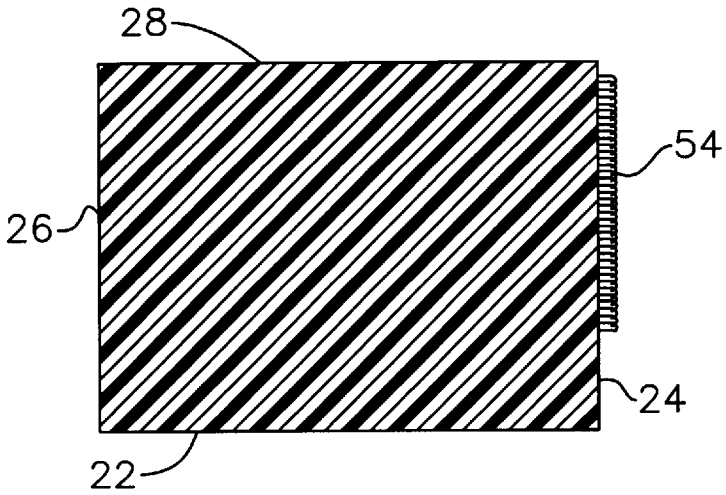
FIG. 3 is an elevational, cross sectional view of the target element utilized in the version of FIG. 1.

Each one of the target elements 16 has a substantially rectilinear shape, although in alternative versions, other non-rectilinear elongate configurations may be utilized. Each target element 16 includes a substantially flat base or bottom surface 22, a pair of generally vertical front and back side surfaces 24 and 26, respectively, and a flat upper surface 28. Although the specific dimensions are not a limitation of this invention, a preferred target element has a thickness of about 2", a width of about 4" and a length of about 21". Target element 16 may be composed of one or more of a variety of natural and synthetic materials. For example, plastic, wood, foam, rubber and a number of other materials may be used. In the version disclosed herein, a plastic construction is utilized, as best shown in FIG. 3. Alternatively, the horizontal playing surface version may employ a foam material, which is encased in a vinyl covering, similar to the water versions described more fully below.

Each target element includes a plurality of discrete target areas 30, 32, 34, 36, 38, 40 and 42. The individual target areas are juxtaposed longitudinally along target element 16.These target areas are formed by a plurality of dividing lines that separate the elongate target element into the individual target areas. Each dividing line includes a vertical segment 44 that extends vertically across side surface 24 of element 16 and a horizontal segment 46 that joins segment 44 and extends across top surface 28 of target element 16. The target areas 30–42 include indicia that assign respective numerical scoring values to the target areas. In the version shown in FIG. 1, seven target areas are formed. The target areas 30 and 42 formed at the respective ends of element 16 are assigned the value "1". The adjacent inner target areas 28 and 40 are assigned the value "2". Target areas 34 and 38 respectively bear the designation "3". Finally, the innermost (i.e. central) target area 36 is assigned the value "5". These values are printed, stamped, etched or formed in any other conventional manner on upper surface 28, within the respective target areas separated by dividing line segments 46. Each target area may also be color coded by a respective colored circle 50. Alternatively, the entire upper surface and/or side surface formed in each target area may carry a respective color. Distinctive shapes may also surround the respective numeric values. This helps the players to distinguish the individual target areas from one another.

Figure 4:
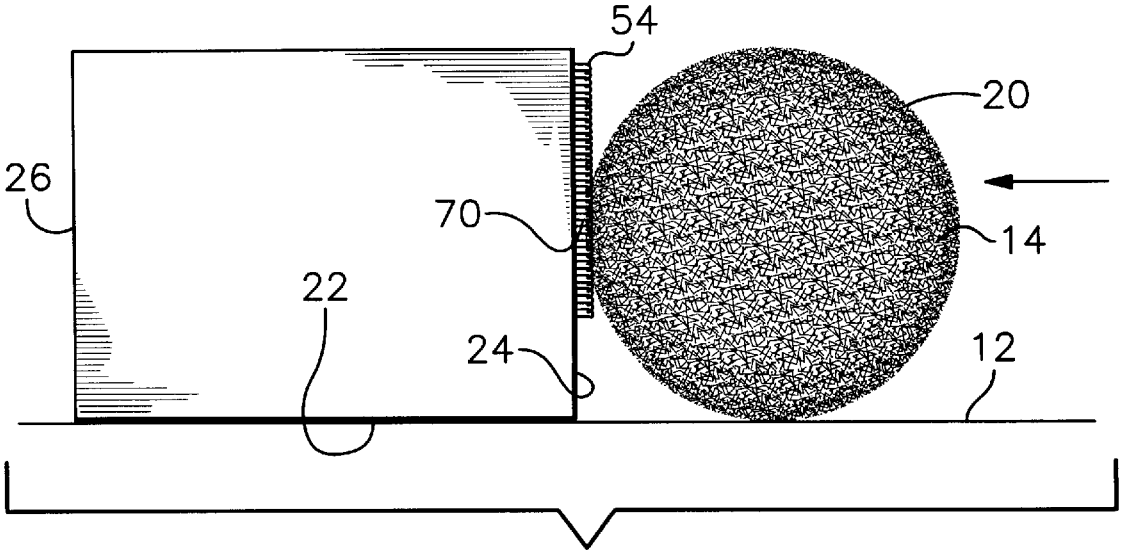
FIG. 4 is an elevational view of the spherical element releasably attached to the target element in the version of FIG. 1.

As shown in FIGS. 1, 3 and 4, each target element 16 supports a strip-like hook and loop fastening component 54. Component 54 is attached to the target element by an adhesive or other known means and extends from the side surface of and outwardly of the target element. The hook component may also be positioned centrally on surface 24 and may cover virtually all of that surface. Fastening component 54 should complement and be releasably interengagable in a standard manner with the loop fastening component 20 formed about ball 14. It should be noted that in alternative embodiments, the hook material may surround the ball and the loop material may extend across front side surface 24 of target element 16. In the embodiment disclosed herein, hook component 54 extends across the vertical target-defining line segments 44 formed in surface 24. In alternative embodiments, the line segments may extend clearly and visibly across component 54. Alternatively, component 54 may be composed of a transparent material such that the line segments 54 are visible through the hook component.

Figure 5:
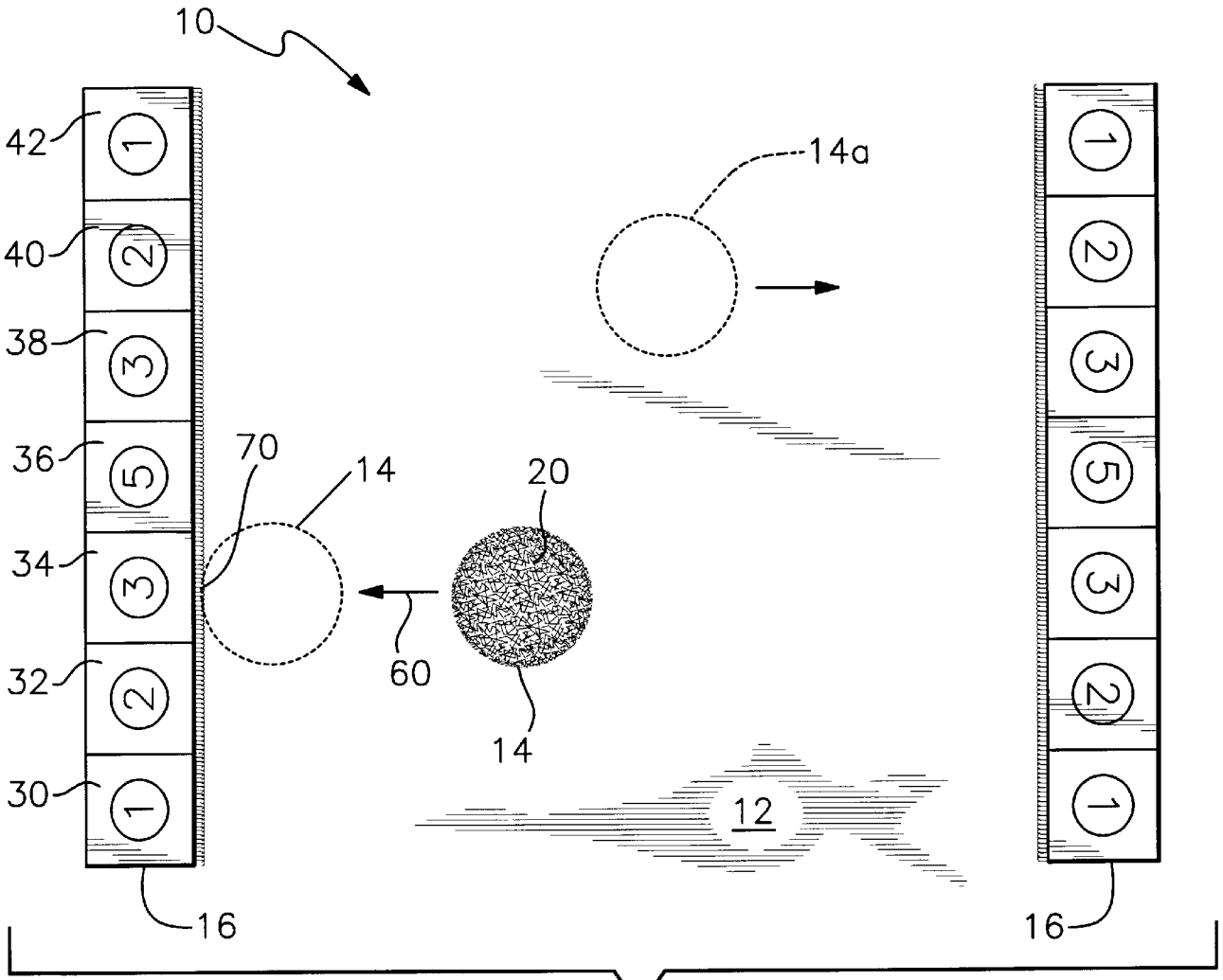
FIG. 5 is a plan view of the game being utilized on a horizontal playing surface.

Game 10 may be played using a number of different rules and scoring systems. The particular target configuration and scoring system are not limitations of this invention. A representative manner in which the game may be practiced is shown in FIGS. 1, 4 and 5. Initially, a pair of target elements 16 is separated by a desired distance (e.g. 10–20 feet is most preferred). The base or bottom surface 22 of each target element is placed against playing surface 12 such that the top surface 28 and the numeric values carried thereon face upwardly. The game may be played between two individuals or, alternatively, between two teams of two or more players each. One person or one member of each team sits behind each target element 16. A first player P, grasps ball 20 in the manner shown in FIG. 1, and rolls the ball across surface 12 in the direction of arrow 60 toward the opposing target element 16. Typically, the player attempts to hit the target element with the ball within, the target area 30–42 having the highest assigned numeric value or score. In the embodiment disclosed herein, this is target area 36, which bears the numeric value "5". Ball 14 is rolled across surface 12 and, if it strikes side surface 24 of element 16 it will tend to stick to the side surface at the point of impact. In particular, as depicted in FIGS. 4 and 5, the loop component 20 carried by ball 14 interengages hook component 54 formed along side surface 24, which causes the ball to releasably adhere to the target element at the point of impact 70. The ball thereby attaches to target element 16 within a discrete one of the target areas 30–42 and the player P is assigned the score that corresponds to that selected target area. In FIG. 5, ball 14, represented in phantom, has engaged target element 16 within target area 34. As a result, the player is assigned a score of three points. A second player positioned behind the target element that has been struck removes ball 14 from the front side surface of the impacted target element by simply pulling the ball away from the target element so that the complementary hook and loop components disengage and separate in a conventional manner. The second player (or another player behind the initially struck target element) is then able to roll the ball, represented by phantom ball 14*a* in FIG. 5, in a reverse direction toward the opposite (right hand) target element 16. If the target element is struck, that player who rolls the ball receives the numerical score associated with the struck target area. The players take turns rolling balls toward respective target elements. Scores are recorded and the game is completed when a predetermined score is obtained by one of the players or teams. As previously indicated, the scoring system can be freely changed and various games, rules and scoring systems may be developed. For example, instead of attempting to reach a total predetermined score, the players may attempt to strike each of the target areas on an opposing target element in a predetermined sequence.

Figure 6:
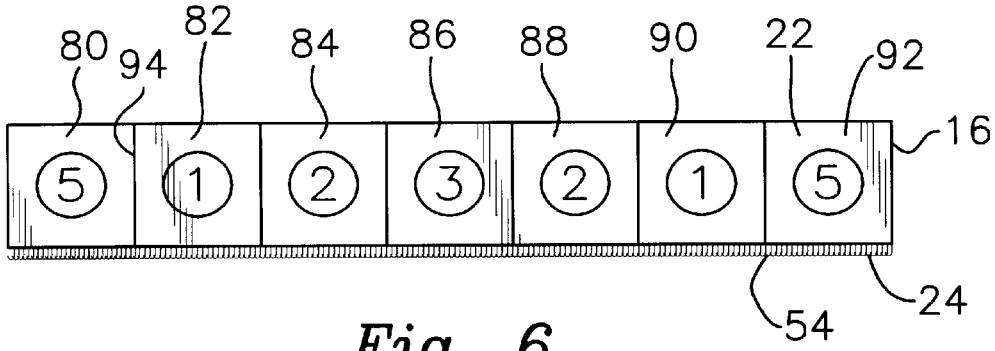
FIG. 6 is an elevational view of the target element's flat bottom base, which base carries a second series of discrete target areas.

As shown in FIG. 6, an entirely different scoring arrangement may be defined on bottom surface 22 of element 16. In this embodiment, the bottom surface includes a longitudinal series of seven juxtaposed target areas 80, 82, 84, 86, 88, 90 and 92. The target areas are divided and defined by a series of horizontal line segments 94 that respectively interconnect with the previously described vertical line segments 44. Each of the target areas 80–92 is assigned a numeric value, which is printed within the target area on bottom surface 22. In this target arrangement, the numeric values "5" are placed on the outermost ends of surface 22 in target areas 80 and 92. The adjacent inner target areas 82 and 90 bear numeric values of "1". The next inner areas 84 and 88 are assigned the values "2". Finally, the central innermost target area bears the designation "3". The target configuration disclosed in FIG. 6 is selected by simply inverting the target element 16, shown in FIGS. 1 and 5, and placing upper surface 28 against playing surface 16. The players then utilize the game in the manner previously described. In this target arrangement the numbers do not increase sequentially in value toward the center of the target. Instead, the highest values are located at the opposite ends of the target. If these target areas are missed even slightly, the player will receive a minimum value "1" or no score at all. As a result, the skill and strategy of the game may be varied by selecting a particular arrangement of target areas and corresponding assigned values. The players may select the values to be used by simply placing either surface 22 or surface 28 against playing surface 12 so that the opposite surface faces upwardly and defines the target values. It should be noted that in either case, hook component 54 is carried on the forward side 24 so that it may be struck and engaged by a ball rolled at the target element.

It should be further understood that game 10 may be practiced using only a single target element 16. One or multiple players may stand or sit a distance away from the target element and roll a ball across the playing surface toward the target element in the manner previously described. Scores are then computed in a similar manner. In still other versions of the game, more than three targets may be utilized.

Figure 7:
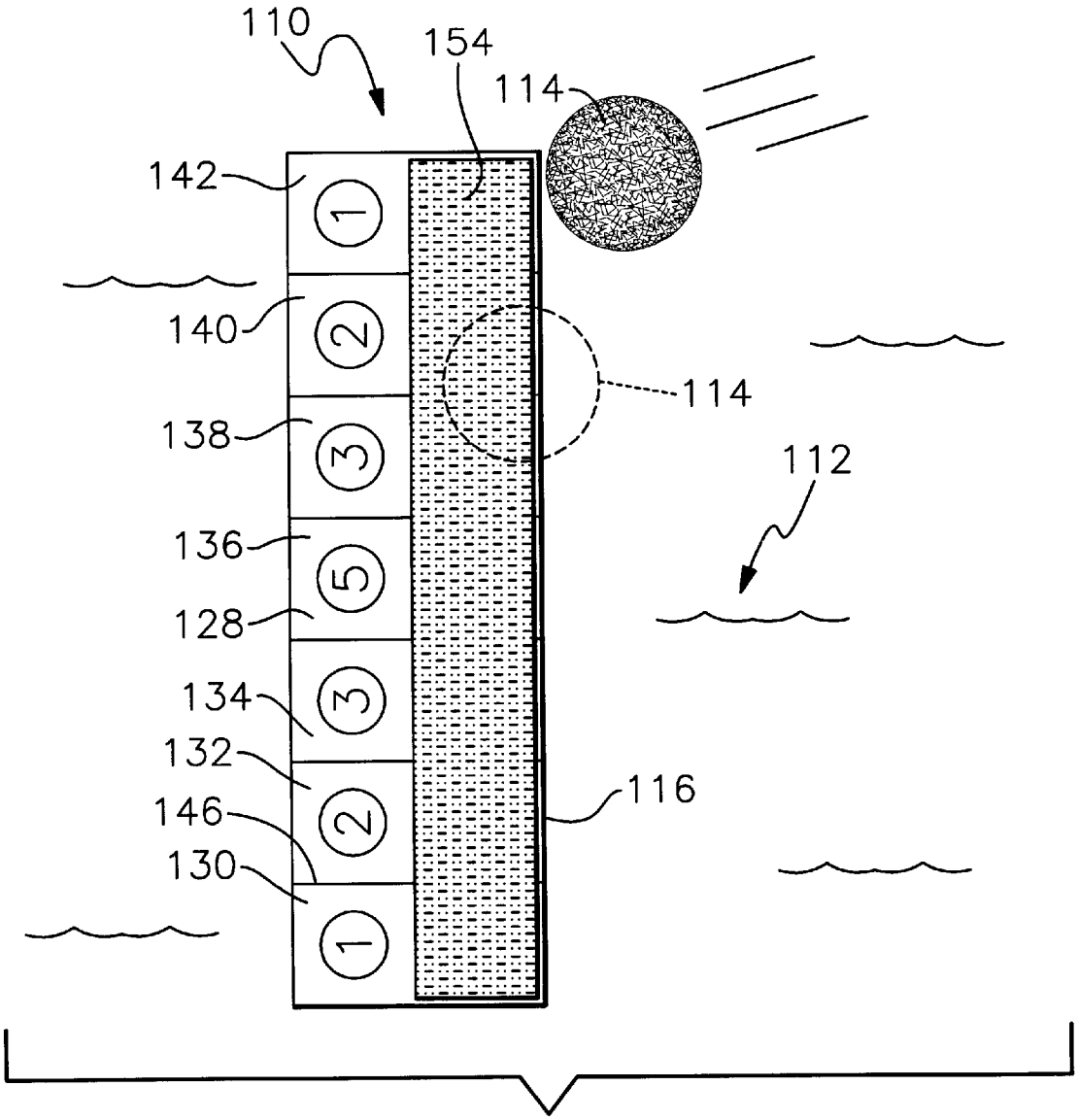
FIG. 7 is a top view of an alternative embodiment of the ball and target game, which employs floatable components and is played in a pool or other body of water.
Figure 8:
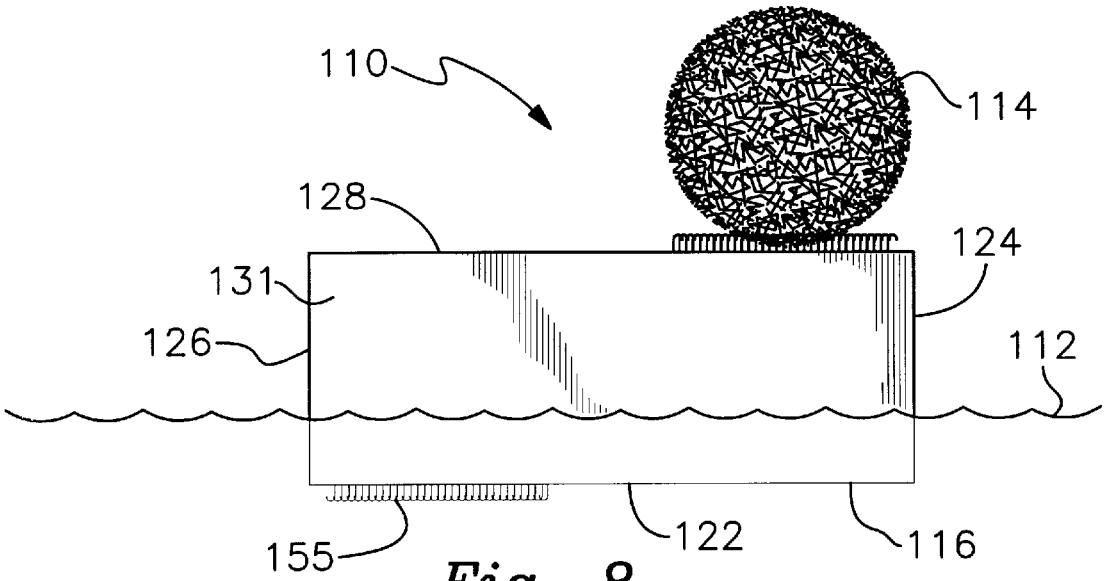
FIG. 8 is an elevational side view of the water version of the game with the ball releasably attached to the target element.
Figure 9:
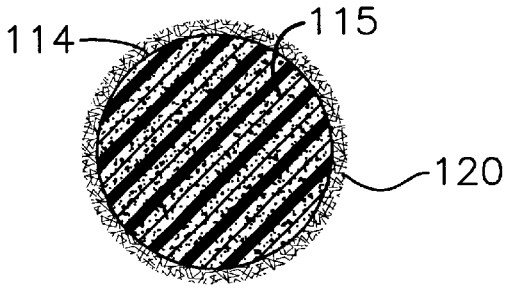
FIG. 9 is an elevational, cross sectional view of a preferred ball employed in the water version of the game.

An alternative ball and target game 110 in accordance with this invention is depicted in FIGS. 7 and 8. In this embodiment, the game is employed in a pool or other body of water 112. The game includes a spherical element or ball 114, shown alone in FIG. 9 and target elements 116 shown alone in FIG. 10. The ball and the target element should be sufficiently buoyant such that they are able to float at the surface of water 112. As shown in FIG. 9, ball 114 may be composed of a closed cell foam 115 that is encased within a loop component 120 of the type previously described. Alternatively, the ball may resemble the ball used for the previous embodiment. The precise construction is not critical. It is simply required that the ball float on the surface of the water.

Figure 10:
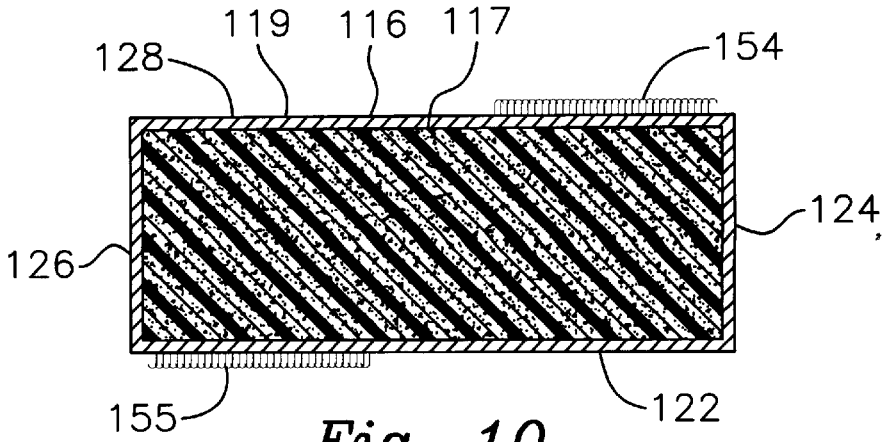
FIG. 10 is an elevational, cross sectional view of a preferred target element employed in the water version of the game.

As shown in FIG. 10, target element 116 includes an inner core 117 that is composed of a closed cell foam. Core 117 is encased in a water resistant, vinyl covering 119. In other versions, the target element may not be encased by an outer covering and may comprise, for example, simply a closed cell foam member. As illustrated in FIGS. 7, 8 and 10, target element 116 again includes a generally rectilinear shape, although other non-rectilinear configurations may be employed. The target element includes a generally flat lower surface 122 and a generally flat upper surface 128. Typically, the target element is somewhat broader and flatter in the water version than in the horizontal playing surface version. For example, a preferred dimensions for the target element 116 are 2" thick, 6" wide and 21" long. These dimensions may be varied within the scope of this invention.

A pair of hook strips 154 and 155 are mounted on surfaces 128 and 122, respectively. These hook components resemble the hook strip described in the previous embodiment. They may be attached to the upper and lower surfaces of the target element 116 by appropriate adhesive or heat welding techniques. Alternative embodiments may feature strips 154 and 155 on one or both of the side surfaces 124 and 126.

As best illustrated in FIGS. 7 and 8, when the target element 116 is floating in water 112, it features an upper portion 131 that is generally exposed above the upper surface of the water. As used herein "generally exposed" means that under relatively calm water conditions the upper portion of the target element is exposed above the water. As the target element is used in a pool or other body of water, it may at times be at least temporarily or fully submerged.

Discrete target areas are carried by both upper surface 128 and lower surface 122. As represented by upper surface 128 in FIG. 7, seven target areas 130, 132, 134, 136, 138, 140 and 142 are juxtaposed longitudinally on upper surface 128. Once again, each adjacent pair of target areas is separated by a transverse line segment 146. Likewise, each target area is assigned a respective numeric scoring value which are printed within the target areas. The values shown in FIG. 7 are analogous to those illustrated in FIGS. 1 and 5. Again, various alternative scoring arrangements may be employed. The scores are typically indicated by numbered and/or colored indicia. Letters and other target indicia may also be utilized in either of the embodiments disclosed herein. It should be understood that a similar plurality of target areas is carried on the bottom surface 122. Typically, a different scoring sequence is utilized so that the participants may choose between alternative types of games. The side surfaces 124 and 126 may also carry target areas in some versions.

As best shown in FIG. 7, hook strip 154 extends across upper surface 128 and transversely intersects the target areas 130–142. As previously described, the hook component obscures the target defining lines. However, in alternative embodiments, the lines may be formed across the hook component or that component may be transparent to reveal the transverse lines beneath it. Component 154, and similarly lower component 155, are releasably interengaged by the loop component 120 covering ball 114 when the ball strikes a hook component on the target element. Accordingly, the hook component permits a ball to stick on the exposed upper surface 128 of target element 116 within a selected one of the target areas 130–142 or analogously within a target area of surface 122 when that surface is exposed above the water.

Game 110 is played by placing one or more target elements 116 in a body of water 112. Each target element floats in the water with one of the sides 128 or 122 facing upwardly and exposed above the water. In the embodiment shown in FIGS. 7 and 8, surface 128 is exposed thereby revealing target areas 130–142. As in the prior embodiment, the game may be played individually or by two or more persons or teams. A player that is spaced apart from a particular one of the target elements 116 grasps ball 114 and throws or otherwise projects the ball toward target 116. Specifically, the ball 114 is projected toward the target in the manner shown in FIG. 7. In some cases, the ball may miss the target entirely. As a result, no score is made. If the ball strikes the target as intended and, more particularly, strikes hook component 154 carried by upper surface 128, the ball will stick to the target element. In particular, loop material 120 encircling the ball releasably engages hook component 154 in the manner shown in phantom in FIG. 7, as well as in FIG. 8. The person throwing the ball receives a score that corresponds to the location that the ball has struck and to which the ball is attached. In FIG. 7, the ball 14 represented in phantom strikes and adheres to hook component 154 within target area 136. As a result, the player receives the numeric score "5" that corresponds to target area 136. Multiple players may alternate throwing one or more balls 114 between one or multiple target elements 116. The game can be played until a predetermined score is reached or some other predetermined goal is achieved.

To play an alternative version of the game, the participants simply flip or invert target element 116 to expose the second, different plurality of discrete target areas carried by the opposite surface 122 of target element 116. For example, an arrangement similar to the arrangement shown in FIG. 6 may be employed on surface 122. In that case, surface 122 and hook component 155 are exposed above the water and the game is practiced in the manner previously described.

It should be understood that, as in the prior embodiment, the hook and loop components may be interchanged (i.e. the ball may carry the hook material and the target element may carry the loop material). Typically, however, because the loop material is more flexible it will be employed in connection with the ball. It should also be understood that the releasable attachment means disclosed herein are not limited to hook and loop material. In alternative embodiments, various other forms of releasable fasteners may be employed. Most notably, magnetic material may be utilized. For example, one of the ball and the target element may carry a magnetic component and the other of the ball and target element may comprise or carry a magnetically attractive material. Typically, the target element supports a magnetic strip that is inlaid or otherwise attached to the forward vertical surface of the target element. In such embodiments, the ball typically includes stainless steel or some other magnetically attractive material that releasably adheres to the magnet of the target component when the ball strikes the target element. In this version, discrete target areas are again formed and the magnet extends across each of the target areas. The ball is rolled toward the target element and, if it strikes the vertical surface of the target element, the ball releasably adheres to the target element within one of the discrete target areas. A corresponding numerical value, which is printed or otherwise applied to the target area, provides the player who rolled the ball with a corresponding score. The game may then be played in a manner analogous to that previously described.

In the magnetic version, the target elements again preferably comprise elongate, rectilinear bars. The bars may be composed of wood or plastic. In certain embodiments, the entire bar may comprise a magnet. Again, a wide variety of scoring systems, rules and target values and arrangements may be utilized.

In still other embodiments of this invention, the target elements may comprise non-elongate components. For example, in a horizontal playing surface version, the target elements may feature a polygonal shape having a plurality of target surfaces which are rotated, pivoted or otherwise moved into the line of travel of the ball. Each such target surface may carry a respective target and corresponding point value. The ball and each target area may also carry complementary releasable means of attachment or magnetic forms of attachment described herein. One player may roll a ball toward the target and the other player may move, spin or rotate the target so that the respective target areas sequentially move into the ball's potential line of travel. If the ball strikes and sticks to a particular target area, a corresponding point value is assigned. In certain embodiments the targets illustrated herein may be moved across the playing surface or water by persons playing the game such that a "moving target" is provided for the ball.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A ball and target game adapted for use on a generally horizontal solid playing surface, said game comprising:

a spherical element that carries a first releasable attachment component; and a target element including a horizontally elongate bar having a substantially planar bottom surface that directly engages the playing surface and a generally planar side surface that extends vertically upwardly from said bottom surface and is continuously solid from a first longitudinal end of said bar to a second longitudinal end of said bar, said side surface including a plurality of discrete target areas juxtaposed longitudinally on said side surface and carrying within each said target area a complementary second releasable attachment component that is releasably interengable with said first releasable attachment component carried by said spherical element, said second releasable attachment component being carried sufficiently close to a lower edge of said side surface such that when said spherical element is rolled along the playing surface and strikes said side surface within a selected target area, said spherical element releasably attaches to said side surface within said selected target area.

2. The game of claim 1 in which said bar has a substantially rectilinear shape.

3. The ball and target game of claim 1 in which at least one of said spherical element and said target element comprise a closed cell foam material.

4. The game of claim 1 in which each said target area includes indicia that assigns a respective value to said target area.

5. The game of claim 1 in which each said target area includes a discrete color region associated with said target area.

6. The game of claim 1 in which one of said attachment components includes hook material attached to one of an outer surface of said spherical element and said side portion of said target element and the other of said attachment components includes loop material attached to the other of the outer surface of said spherical element and said side portion of said target element, said loop material being releasably interengable with said hook material to releasably adhere said spherical element to said target element.

7. The game of claim 1 in which said side surface extends perpendicularly upwardly from said bottom surface.

8. A ball and target game comprising:

a generally horizontal solid playing surface;

a spherical element that engages said playing surface and carries a first releasable attachment component; and a target element including a horizontally elongate bar having a generally planar bottom surface that directly engages the playing surface and a generally planar side surface that extends vertically upwardly from said bottom surface and is continuously solid from a first longitudinal end of said bar to a second longitudinal end of said bar, said side surface including a plurality of discrete target areas juxtaposed longitudinally on said side surface and carrying within each said target area a complementary second releasable attachment component that is releasably interengable with said first releasable attachment component carried by said spherical element, said second releasable attachment component being carried sufficiently close to a lower edge of said side surface such that when said spherical element is rolled along the playing surface and strikes said side surface within a selected target area, said spherical element releasably attaches to said side surface within said selected target area.

9. The game of claim 8 in which said bar has a substantially rectilinear shape.

10. The game of claim 8 in which each said target area carries printed indicia that assigns a respective value to said target area.

11. The game of claim 8 in which each said target area includes a discrete color region associated with said target area.

12. The game of claim 8 in which one of said attachment components includes hook material that is attached to one of an outer surface of said spherical element and said side portion of said target element and the other of said components includes loop material that is attached to the other of the outer surface of the spherical element and said side portion of said target element, said loop material being releasably interengagable with said hook material to releasably adhere said spherical element to said target element.

13. A method of practicing a ball and target game, said method comprising:

providing a generally horizontal solid playing surface;

providing a spherical element that carries a first releasable attachment component;

providing a target element in the form of a horizontally elongate bar including a substantially planar base portion that directly engages said playing surface and a targeted side surface extending generally vertically upwardly from said bottom surface and being continuously solid from a first longitudinal end to a second longitudinal end of said bar;

juxtaposing a plurality of discrete target areas longitudinally on said bar;

providing within each said target area on said side surface a complementary releasable attachment component, which said second attachment component is releasably interengable with said first attachment component; and rolling said spherical element along said playing surface and striking said side surface within a selected target area such that said spherical element releasably attaches to said side surface within said selected target area.

* * * * *